United States Patent [19]

Ritter

[11] 4,436,217

[45] Mar. 13, 1984

[54] PAINT BRUSH SUPPORT

[76] Inventor: John C. Ritter, 12645 Duchess, Detroit, Mich. 48224

[21] Appl. No.: 327,413

[22] Filed: Dec. 4, 1981

[51] Int. Cl.[3] ..... A46B 17/02

[52] U.S. Cl. ..... 220/85 D; 206/361; 220/90; 248/110

[58] Field of Search ..... 15/257.05, 248 R; 401/125, 6, 15, 123, 131; 206/361, 362, 15.2, 15.3, 362, 1, 806, 362.2, 362.3, 362.4; 248/110, 111, 112, 223.1, 222.4, 225.1; 220/85 R, 85 D, 90; 40/331

[56] References Cited

U.S. PATENT DOCUMENTS

| | | | |
|---|---|---|---|
| 413,526 | 10/1889 | Light | 15/264 |
| 604,359 | 5/1898 | Beam | 220/90 |
| 675,945 | 6/1901 | Gordon | 401/125 |
| 775,526 | 11/1904 | Dunbar | 248/111 |
| 1,153,730 | 9/1915 | Thompson | 206/361 |
| 1,451,894 | 4/1923 | Jordan | 220/85 R X |
| 1,471,712 | 10/1923 | Sohnle | 206/362 |
| 1,834,374 | 12/1931 | Berg | 206/361 |
| 1,851,521 | 3/1932 | Olsen | 206/361 |
| 1,949,912 | 3/1934 | Johnson | 206/15.1 |
| 2,533,159 | 12/1950 | Yates | 220/356 |
| 2,594,176 | 4/1952 | Kaiser, Jr. | 220/85 D X |
| 2,634,937 | 4/1953 | Welsh | 248/211 |
| 2,654,504 | 10/1953 | Hyams | 220/85 |
| 2,674,757 | 4/1954 | Keyes, Jr. | 15/121.2 |
| 2,748,977 | 6/1956 | Sarchet | 220/90 |
| 2,808,960 | 10/1957 | Wilson | 220/85 R |
| 2,988,768 | 6/1961 | Hill | 15/517 |
| 3,000,491 | 9/1961 | McIntosh | 206/361 |
| 3,032,177 | 5/1962 | Majors | 206/15.2 |
| 3,168,962 | 2/1965 | Rawlins et al. | 220/90 |
| 3,230,573 | 1/1966 | Hilberg | 401/125 X |
| 3,397,804 | 8/1968 | Davis | 220/20 |
| 3,406,812 | 10/1968 | Henry | 206/15.1 |
| 3,407,429 | 10/1968 | Di Nardo | 248/110 X |
| 3,460,899 | 8/1969 | Miller | 21/83 |
| 3,688,943 | 9/1972 | Brown | 220/90 |
| 3,837,034 | 9/1974 | Leffert et al. | 15/257.06 |
| 3,841,478 | 10/1974 | Wells et al. | 206/806 X |
| 3,997,091 | 12/1976 | Burnette | 206/806 X |
| 4,025,206 | 5/1977 | Rubin | 401/123 |
| 4,044,890 | 8/1977 | Kramming | 206/806 X |
| 4,183,444 | 1/1980 | English et al. | 220/85 R X |
| 4,215,840 | 8/1980 | Babberl | 248/221.4 |
| 4,216,598 | 8/1980 | Newbert | 40/331 |

FOREIGN PATENT DOCUMENTS

| | | |
|---|---|---|
| 157320 | 2/1905 | Fed. Rep. of Germany . |
| 494435 | 11/1938 | United Kingdom . |

*Primary Examiner*—Allan N. Shoap
*Assistant Examiner*—Robert Petrik
*Attorney, Agent, or Firm*—Basile, Weintraub & Hanlon

[57] ABSTRACT

A paint brush support that is attached to the outer portion of a paint container is disclosed. The support comprises a brush container in the form of an open top vessel having an opening formed at an upper edge of an inside wall. The opening snugly engages a bale support button of the paint container to support the brush container to the paint container. An elastic ring snugly engageable with the paint container holds the brush container in abutment to the paint container.

6 Claims, 5 Drawing Figures

PAINT BRUSH SUPPORT

BACKGROUND OF THE INVENTION

1. Field of the Invention

The present invention generally relates to the field of painting apparatus. In particular, the present invention is concerned with a paint brush support attachable to the outer portion of a paint container.

2. Description of the Prior Art

Painting implement holders supported by a paint container have long been known in the art. A variety of methods have been proposed for supporting a paint brush either inside or outside the paint container. Such painting implement supports generally utilize the rim of the container and a hook device to attach the implement support to the container. Examples of painting implement supports in the prior art are disclosed in United States Letters Pat. Nos. 413,526; 604,359; 675,945; 775,526; 1,471,712; 1,949,912; 2,634,937; 2,654,504; 2,674,757; 2,748,977; 2,988,768; 3,032,177; 3,168,962; 3,397,804; 3,406,812; 3,460,899; 3,688,943; 3,837,034; 4,025,206; British Pat. No. 494,435; and German Pat. No. 157320. These patents are relevant to the Applicant's invention in that they represent the closest prior art for attaching a painting implement support to a paint container. However, none of the references disclose nor anticipate a paint brush support attached to the paint container by a bale support button on the paint container.

3. Prior Art Statement

The aforementioned prior art, in the opinion of the Applicant and the Applicant's Attorney, represents the closest prior art of which the Applicant and his Attorney are aware.

SUMMARY OF THE INVENTION

The present invention, which will be described in greater detail hereinafter, comprises a paint brush support releasably attached to the outer portion of a paint container. The paint container includes a bale or handle for carrying the container, and a pair of spaced apart bale attachment buttons attached to the container exterior for securing the bale to the container. The brush support comprises a brush container in the form of an open top vessel including an inside wall, a pair of opposed wedged shaped sidewalls integral with the inside wall with the wide end of the wedge at the top thereof. An outside wall extends between the sidewalls and is joined to a bottom edge of the inside wall to enclose the vessel. A central projection extends upward from a top edge of the inside wall, and an aperture formed in the central projection snugly engages the bale attachment button to secure the brush container to the paint container. A slot is formed in the central projection extending outward from the aperture to clear the bale or handle as the brush container is placed over the bale attachment button.

It is therefore a primary object of the present invention to provide a new and improved paint brush support.

It is a further object of the present invention to provide such a paint brush support that may be releasably attached to the outer portion of a paint container utilizing a bale attachment button for securing the brush support to the container.

It is yet another object of the present invention to provide a new and improved paint brush support that is economical to manufacture and convenient to use.

Further objects, advantages, and applications of the present invention will become apparent to those skilled in the art of painting implement supports when the accompanying description of one example of the best mode contemplated for practicing the invention is read in conjunction with the accompanying drawing.

BRIEF DESCRIPTION OF THE DRAWING

The description herein makes reference to the accompanying drawing wherein like reference numbers refer to like parts throughout the various several views, and wherein.

DESCRIPTION OF THE PREFERRED EMBODIMENT

Figure 1:
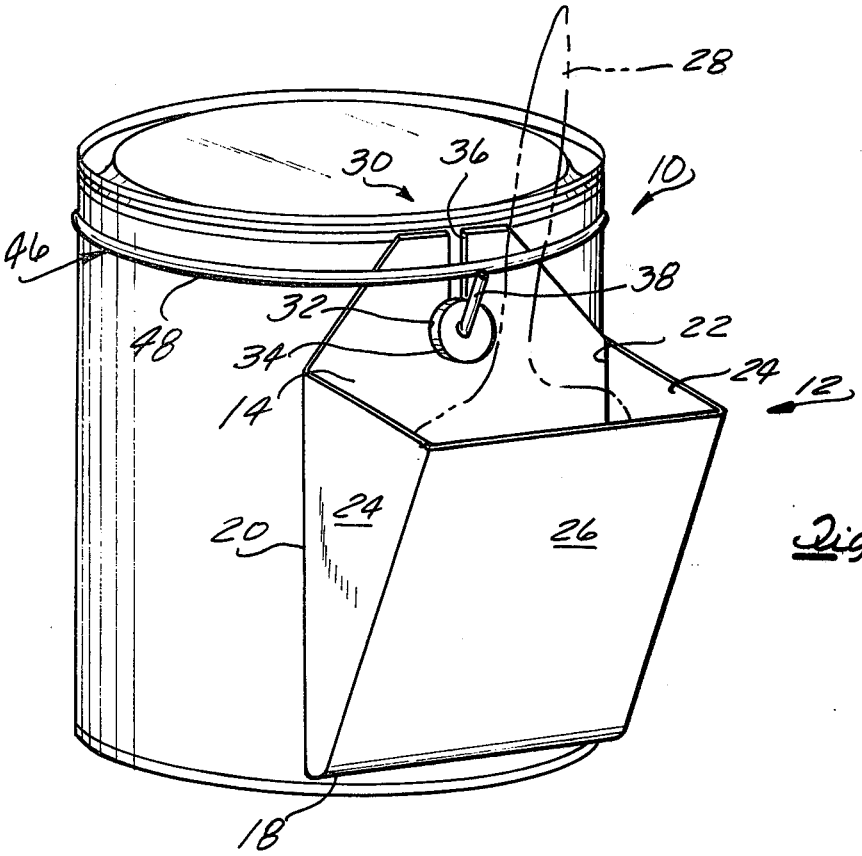
FIG. 1 illustrates a perspective view of the paint brush support of the present invention mounted to a paint container.

Referring now to the drawing, there is illustrated at 10 in FIG. 1 the preferred embodiment in the form of a brush support or container 12 which includes an inside wall 14 a bottom edge 18 and opposed side edges 22. A pair of opposed wedged shaped side walls 24 are integral with the opposed side edges 20, 22 and have the wide portion of the wedge at the top thereof. An outside wall 26 extends between side walls and is joined to the bottom edge 18 to enclose the brush container or vessel 12 and support a paint brush. In a preferred embodiment the included angle 25 of the wedge is twenty two degrees to best preserve the shape of the brush bristles and allow easy insertion of the brush.

Figure 3:
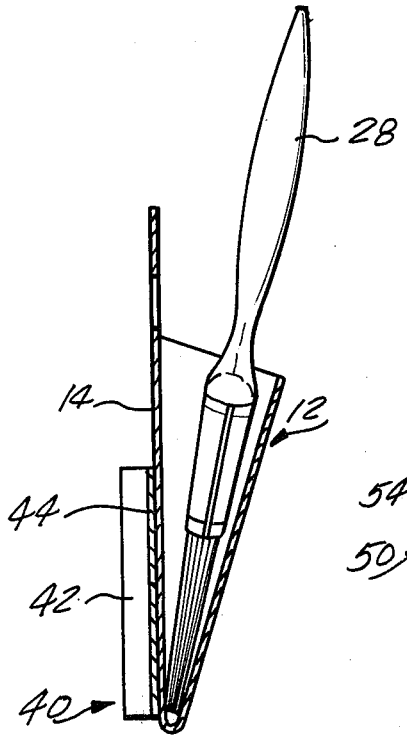
FIG. 3 illustrates a cross sectional view of the paint brush container of the present invention taken along the line 3—3 of FIG. 2.

As shown in FIG. 3 of the drawing, the wedge shaped sides 24 provide a convenient wedge shape for the brush container 12 which aids in preserving the shape of the brush 28. The shape of the container 12 also avoids rapid drying out of the brush when supported in the container and preserves the brush for a longer period of use.

A central projection 30 extends upward from the inside wall 14, and an aperture 32 formed therein is configured to snugly engage a bale attachment button 34. A slot 36 extends outward from the aperture 32 to clear a bale or carrying handle 38 when the brush container 12 is mounted to the paint container.

Figure 2:
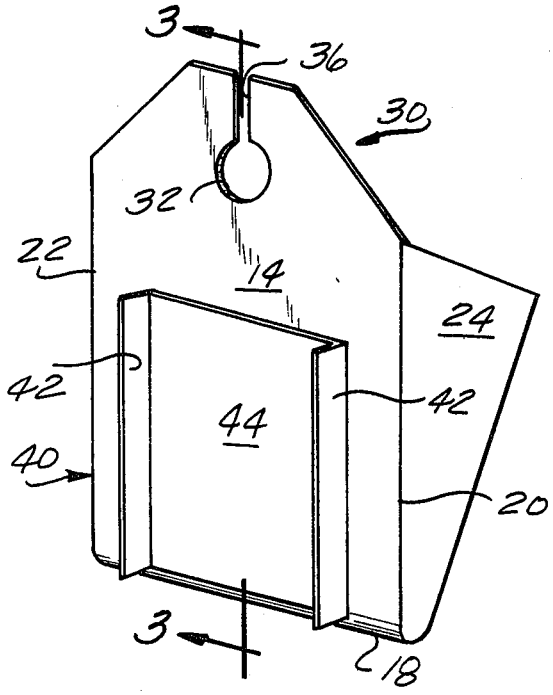
FIG. 2 illustrates a rear perspective view of the paint brush container of the present invention.
Figure 4:
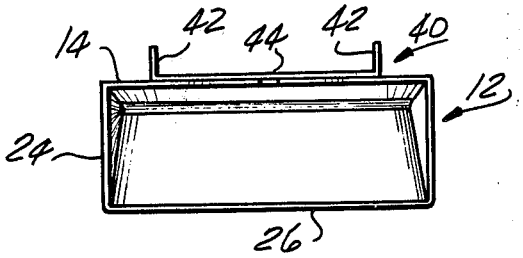
FIG. 4 illustrates a top view of the paint brush container of the present invention.

As shown in FIGS. 2, 3, and 4 of the drawing, the brush container 12 further includes a U-shaped flange 40 attached to the inside wall 14. The flange 40 includes a pair of legs 42 which extend outward to abut the paint container outer portion and to stabilize the brush container 12 preventing rotation of the container relative to the bale support button 34. The flange 40 comprises a planar wall 44 integral with the pair of legs 42 which extend outward therefrom. The planar wall 44 abuts the inside wall 42 and is attached thereto by riveting, spot welding, or an adhesive.

In a preferred embodiment as illustrated in FIG. 1, of the drawing, a retaining means 46 is provided to hold the brush container 12 in abutment with the paint container. In the preferred embodiment the retaining means 46 comprises an elastic ring 48 which is snugly engageable with the outer portion of the paint container and overlays the central projection 30 to hold the central projection and the inside wall 14 in abutment with the outer portion of the paint container.

Figure 5:
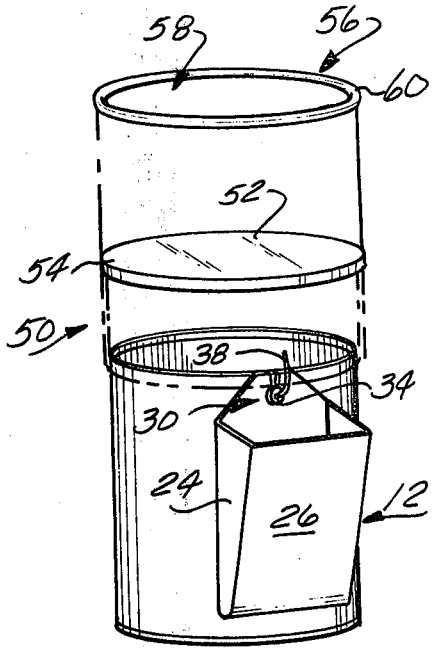
FIG. 5 illustrates a paint brush container of the present invention supported by a paint container and retained thereto by a reusable paint lid lip.

FIG. 5 of the drawing illustrates at 50 an alternate retaining means for securing the brush container 12 to the paint container. The alternate retaining means 50 comprises a removable, resealable lid 52 having a downward extending circumferential lip 54 which, when the lid is in place overlays the central projection 30 to hold the brush container 12 in abutment with paint container. To hold the paint container 12 in abutment with the paint container while painting, the lid 52 is replaced with a lid 56 having an access opening 58 formed therein. The open lid 56 includes a downward extending circumferential lip 60 to provide retention of the brush container 12 in abutment with the paint container but also to provide access to the interior of the paint container through the opening 58.

It can thus be seen that the present invention has provided a new and improved paint brush support that is convenient to use and is easily attached to the outside portion of the paint container. The paint brush support of the present invention also preserves and retains the shape and paint spreading ability of the brush throughout its usefull life.

It should be understood by those skilled in the art of painting implement supports that other forms of the Applicant's invention may be had, all coming within the spirit of the invention and the scope of the appended claims.

Having thus described my invention what I claim is:

1. A paint brush support attachable to the outer portion of a paint container having a bale attached to the outer portion of the paint container by a bale attachment button, the paint brush support comprising:

a brush container, the brush container comprising a vessel having an open top, an inside wall having a top edge, opposed side walls and an outside wall;

an aperture formed in the inside wall of the brush container, the aperture being snugly engageable with the bale attachment button to support the brush container on the paint container; and a slot extending from the top edge of the inner wall of the brush container to the aperture to clear the bale when mounting the brush container on the bale attachment button.

2. The paint brush support as defined in claim 1 wherein:

the opposed side walls of the vessel have a wedge shape extending from a lower narrow end to an upper wide end; and the included angle of the wedge is twenty two degrees.

3. The paint brush support as defined in claim 1 further comprising:

a central projection comprising an upward extension of the inside wall of the vessel, the central projection extending above the tops of the side walls of the vessel; and means for securing said central projection in abutment with the outer portion of the paint container, the securing means comprising an elastic ring snugly engageable with the outer portion of the paint container, the ring passing over the central projection.

4. The paint brush support as defined in claim 1 further comprising a U-shaped flange attached to the inside wall of the vessel, said flange including a pair of legs abutting the outer portion of the paint container.

5. The paint brush support as defined in claim 1 further comprising:

a central projection comprising an upward extension of the inside wall of the vessel, the central projection extending above the tops of the side walls upward to an upper edge of the paint container; and a reusable paint container lid provided with a downward extending side wall overlays the central projection to secure the inside wall of the vessel in abutment with the paint container during storage.

6. A paint brush support releasably attached to the outer portion of a paint container, including a bale for carrying the container and a bale attachment button for securing the bale to the paint container, the brush support comprising:

a brush container in the form of an open top vessel including an inside wall having a top edge, a bottom edge, and opposed side edges, a pair of opposed wedge shaped side walls integral with the opposed side edges with the wide end of the wedge at the top thereof, an outside wall extending between the side walls and joined to the bottom edge to enclose the vessel;

a central projection extending upward from the top edge of the inside wall of the vessel: an aperture formed in the central projection with a slot extending outward therefrom to clear the bale, the aperture being snugly engageable with the bale attachment button to support the brush container on the paint container;

a U-shaped flange attached to the inside wall of the vessel, the flange including a pair of legs abutting the outer portion of the paint container; and retaining means comprising an elastic ring snugly engageable with the outer portion of the paint container and overlaying the central projection of the vessel in in abutment with the outer portion of the paint container.

* * * * *